US009280118B2

(12) United States Patent
Endo

(10) Patent No.: US 9,280,118 B2
(45) Date of Patent: Mar. 8, 2016

(54) IMAGE FORMING APPARATUS

(71) Applicant: CANON KABUSHIKI KAISHA, Tokyo (JP)

(72) Inventor: Terutaka Endo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/508,828

(22) Filed: Oct. 7, 2014

(65) Prior Publication Data

US 2015/0098741 A1 Apr. 9, 2015

(30) Foreign Application Priority Data

Oct. 9, 2013 (JP) ..... 2013-211993

(51) Int. Cl.

| | |
|---|---|
| ***G03G 15/00*** | (2006.01) |
| ***B65H 85/00*** | (2006.01) |
| ***B65H 9/00*** | (2006.01) |
| ***B65H 5/06*** | (2006.01) |
| ***B65H 5/26*** | (2006.01) |
| ***B65H 29/60*** | (2006.01) |
| ***G03G 15/23*** | (2006.01) |
| ***B65H 9/16*** | (2006.01) |

(52) U.S. Cl.

CPC ..... *G03G 15/6529* (2013.01); *B65H 5/068* (2013.01); *B65H 5/26* (2013.01); *B65H 9/002* (2013.01); *B65H 9/166* (2013.01); *B65H 29/60* (2013.01); *B65H 85/00* (2013.01); *G03G 15/235* (2013.01); *G03G 15/6561* (2013.01); *G03G 15/6567* (2013.01); *B65H 2301/3332* (2013.01); *B65H 2404/172* (2013.01); *B65H 2404/174* (2013.01); *G03G 2215/00438* (2013.01); *G03G 2215/00565* (2013.01); *G03G 2215/00675* (2013.01); *G03G 2215/00679* (2013.01)

(58) Field of Classification Search

CPC ..... G03G 15/00; G03G 2215/00438; G03G 15/6567; G03G 15/6561; G03G 15/235; G03G 2215/00679; G03G 2215/00675; G03G 2215/00565; B65H 15/00; B65H 85/00; B65H 29/60; B65H 5/26; B65H 5/36; B65H 5/068; B65H 9/002; B65H 9/00; B03G 15/6529

See application file for complete search history.

(56) References Cited

U.S. PATENT DOCUMENTS 5,162,857 A * 11/1992 Higeta et al. ..... 399/401

FOREIGN PATENT DOCUMENTS

| | | | | |
|---|---|---|---|---|
| GB | 1048006 A | * | 11/1966 | |
| JP | 01019365 A | * | 1/1989 | ..... G03G 15/00 |
| JP | 01019366 A | * | 1/1989 | ..... G03G 15/00 |
| JP | 04164753 A | * | 6/1992 | ..... G03G 15/00 |
| JP | 07237802 A | * | 9/1995 | ..... G03G 15/00 |

(Continued)

*Primary Examiner* — Nguyen Ha

(74) *Attorney, Agent, or Firm* — Canon USA Inc. IP Division

(57) ABSTRACT

An image forming apparatus includes an image forming unit configured to form an image on a sheet, a duplex conveyance path through which the sheet having the image formed by the image forming unit on a first side passes when an image is formed on a second side that is a back side of the first side, a guiding member provided along the duplex conveyance path, a reversing roller pair capable of rotating in a forward direction and in a reverse direction, and a conveyance roller pair provided on the duplex conveyance path, wherein at least one of the reversing roller pair is inclined to the width direction so that, in the width direction, the side end of the sheet being conveyed by the reversing roller pair rotating in the reverse direction moves closer to the contact portion.

17 Claims, 12 Drawing Sheets

(56) References Cited

FOREIGN PATENT DOCUMENTS

| | | | | | |
|---|---|---|---|---|---|
| JP | 2004294988 | A | * | 10/2004 | G03G 15/00 |
| JP | 2005154123 | A | * | 6/2005 | B65H 29/00 |
| JP | 2007-062960 | A | | 3/2007 | |
| JP | 2007261716 | A | * | 10/2007 | B65H 85/00 |
| JP | 2011037569 | A | * | 2/2011 | G03G 15/00 |
| JP | 2012098374 | A | * | 5/2012 | B65H 85/00 |

* cited by examiner

IMAGE FORMING APPARATUS

BACKGROUND OF THE INVENTION

1. Field of the Invention

The present invention relates to an image forming apparatus having a mechanism for moving a sheet in a direction orthogonal to a conveyance direction in image formation onto a back side of the sheet having an image formed on one side.

2. Description of the Related Art

A conventional image forming apparatus for two-sided printing having a mechanism in which a switchback operation is performed on a sheet having a printed image on one side and the sheet is moved toward a lateral direction to a conveyance direction (which is discussed in Japanese Patent Application Laid-Open No. 2007-62960) is described. As illustrated in FIG. 9, a sheet S picked by a sheet feeding roller 901 is conveyed by a registration roller pair 902. On one side of the sheet S, a toner image is transferred by a transfer roller 903, and the toner image is fixed by a fixing roller 904.

When images are formed on the both sides of the sheet S, after a trailing end of the sheet S conveyed by a discharge reversing roller 905 passes through a point C, the discharge reversing roller 905 rotates in a reverse direction (the rotation direction changes to the opposite direction). Then, the sheet S is moved to a side in the direction orthogonal to the conveyance direction (a width direction of the sheet S) by a skew feed roller 906, and the sheet S comes in contact with a reference guide 910.

In a state where a positional accuracy in the width direction of the sheet S is ensured, the sheet S is conveyed by a re-feed roller 907 to merge with a conveyance path of a first side, and conveyed toward the registration roller pair 902. Then, an image is formed on the back side of the sheet S by the transfer roller 903 and the fixing roller 904, and the sheet S is discharged onto a discharge tray 909 by the discharge reversing roller 905.

With the recent demands for downsizing of an image forming apparatus, a conveyance distance from a discharge reversing roller to a re-feed roller tends to be shortened. Further, since a degree of curves of the curved conveyance paths tends to increase due to downsizing of an image forming apparatus, frictional resistance between a sheet and a conveyance guide also increases. As a result, in some cases, a sheet cannot be moved by a skew-feed roller by a required amount so as to cause the sheet to fit along a reference guide.

SUMMARY OF THE INVENTION

The present invention is directed to providing an image forming apparatus capable of ensuring printing accuracy in a width direction of a sheet by increasing an amount of movement of the sheet having an image formed on one side to enable the sheet to sufficiently move along a reference guide surface.

According to an aspect of the present invention, an image forming unit configured to form an image on a sheet, a duplex conveyance path through which the sheet having the image formed by the image forming unit on a first side passes when an image is formed on a second side that is a back side of the first side, a guiding member provided along the duplex conveyance path, the guiding member having a contact portion with which a side end that is one end portion of the conveyed sheet in a width direction comes in contact, a reversing roller pair capable of rotating in a forward direction and in a reverse direction, the reversing roller pair rotating in the reverse direction after rotating in the forward direction to convey the sheet toward the duplex conveyance path, and a conveyance roller pair provided on the duplex conveyance path, the conveyance roller pair being configured to convey the sheet toward the image forming unit, wherein at least one of the reversing roller pair is inclined to the width direction so that, in the width direction, the side end of the sheet being conveyed by the reversing roller pair rotating in the reverse direction moves closer to the contact portion.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 7:
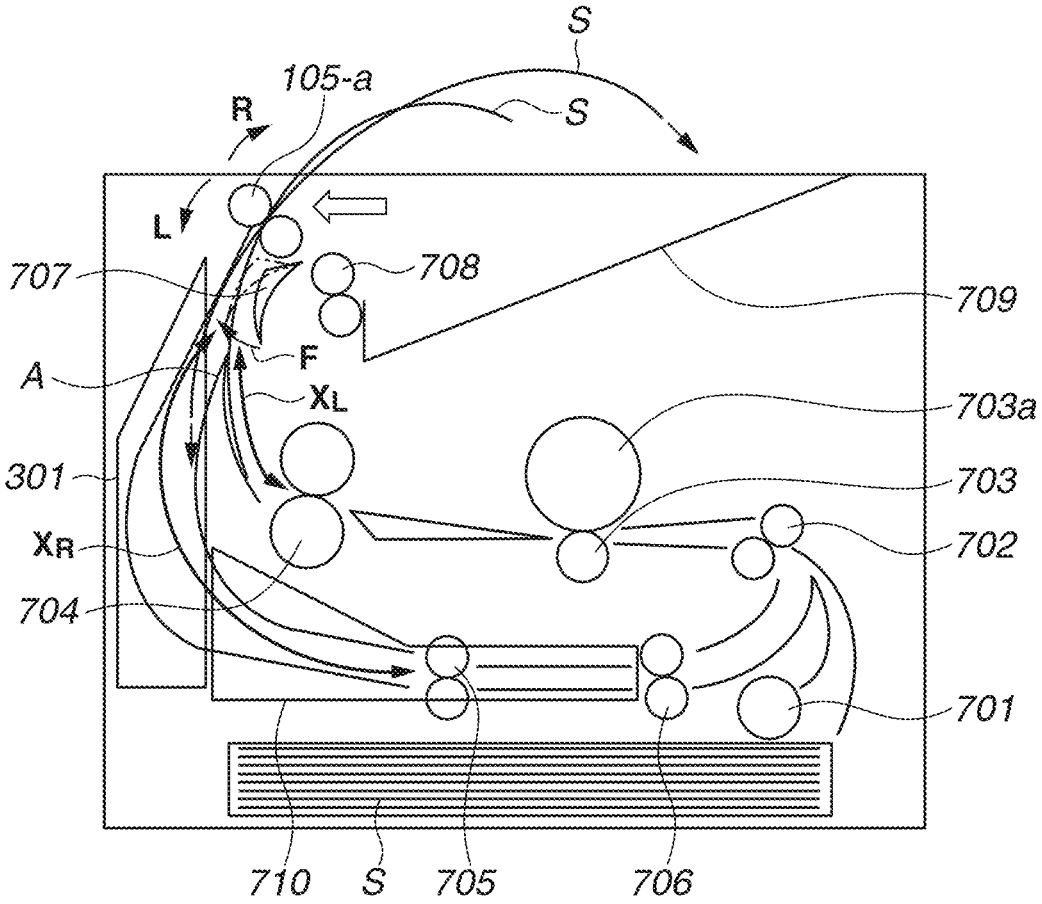
FIG. 7 is a schematic overall view illustrating an image forming apparatus according to the first exemplary embodiment.

A first exemplary embodiment of the present invention is described below. Drawings relating to the first exemplary embodiment will be described. FIG. 7 is a cross-sectional view illustrating a schematic configuration of an image forming apparatus according to the first exemplary embodiment. The right side in FIG. 7 is the front side of the image forming apparatus, and the left side in FIG. 7 is the back side of the image forming apparatus.

Figure 1A:
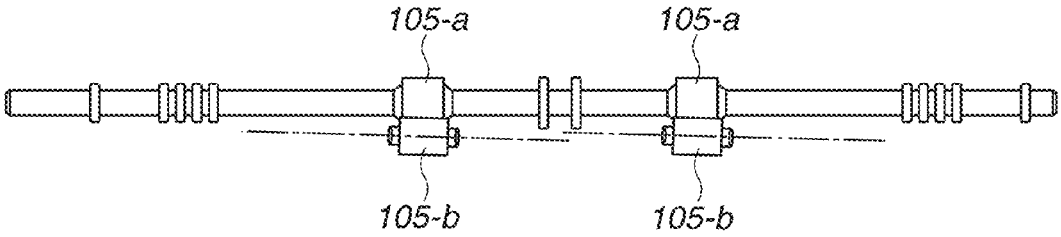
FIGS. 1A and 1B are diagrams each illustrating a reverse switchback roller pair according to a first exemplary embodiment.
Figure 1B:
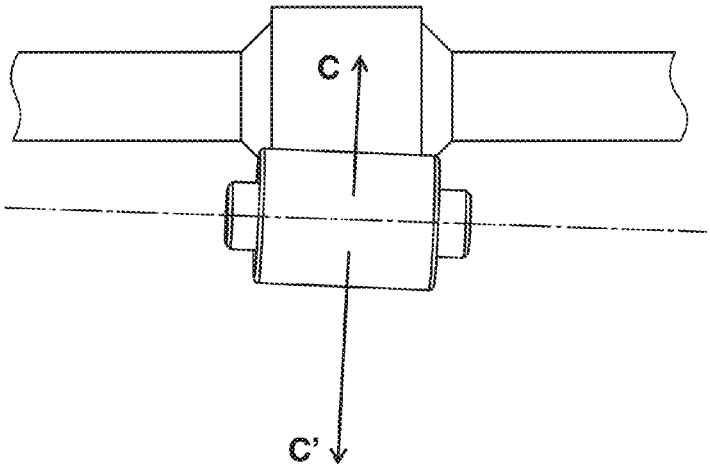
Figure 2:
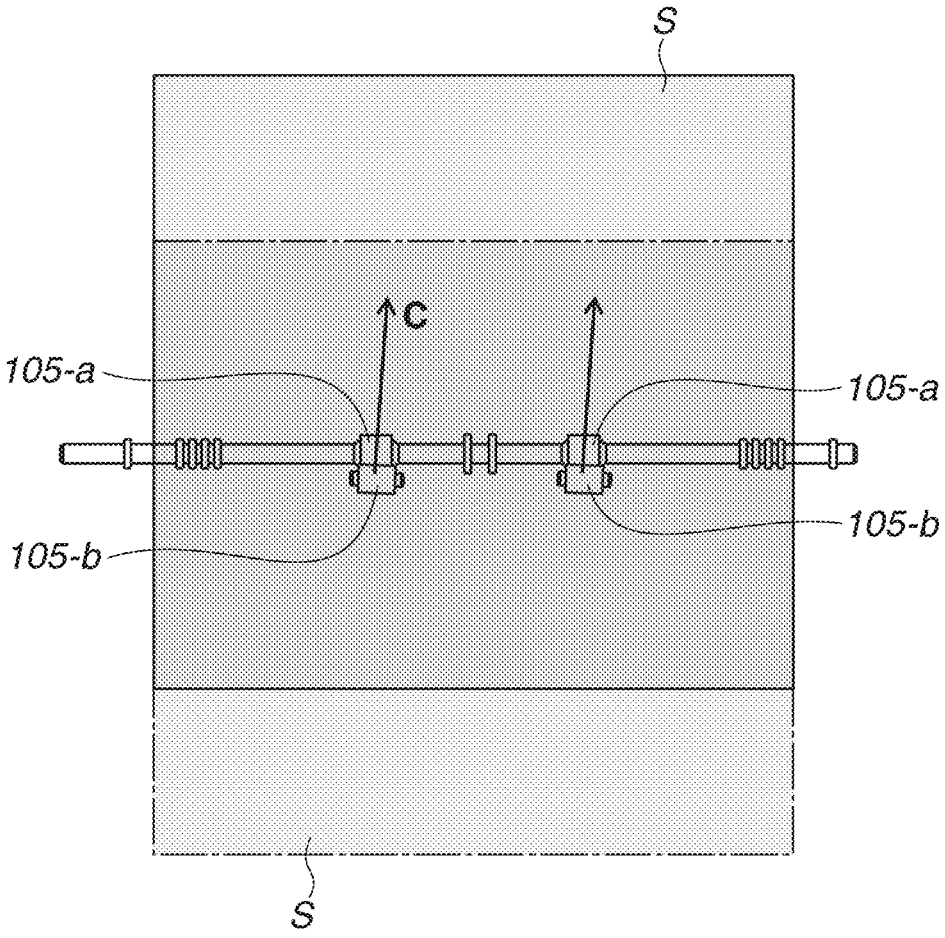
FIG. 2 is a diagram illustrating a forward direction rotation of the reverse switchback roller pair and a sheet conveyance direction according to the first exemplary embodiment.
Figure 3:
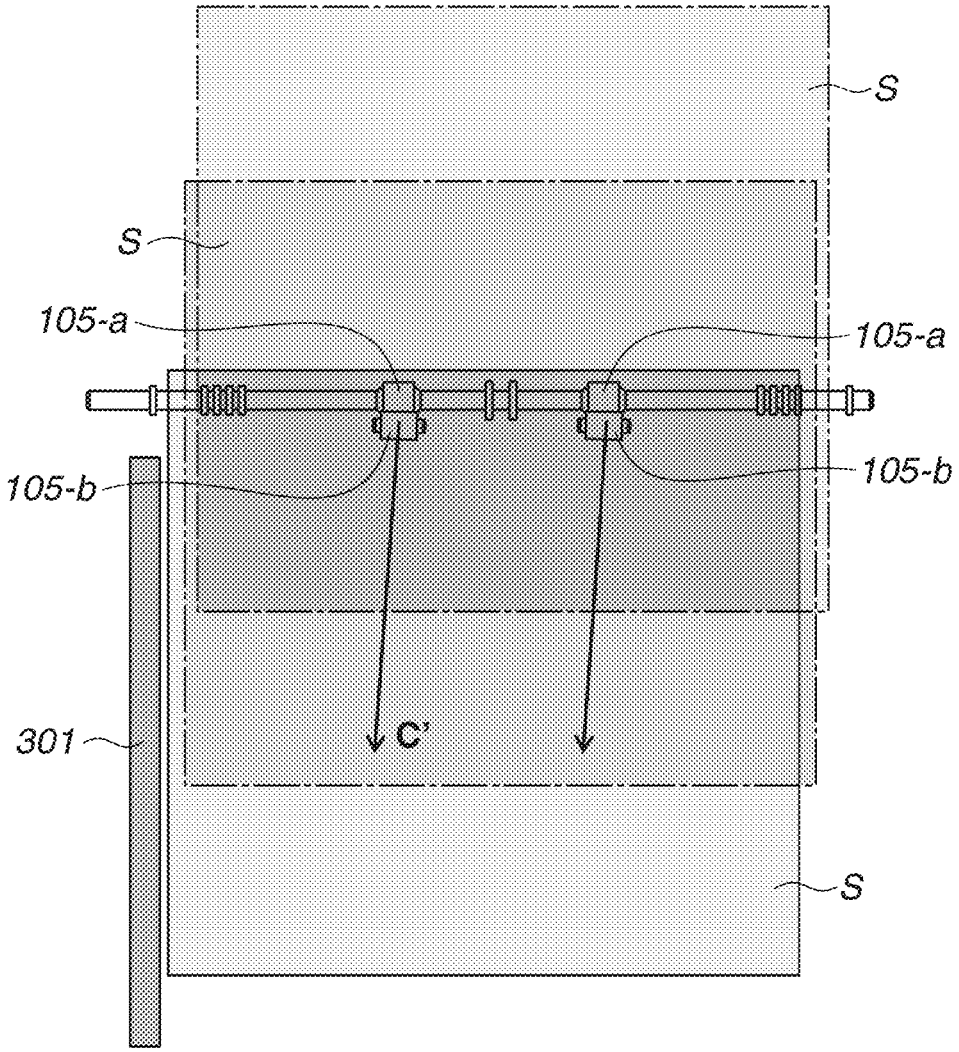
FIG. 3 is a diagram illustrating a reverse direction rotation of the reverse switchback roller pair and a sheet conveyance direction according to the first exemplary embodiment.

FIGS. 1A and 1B illustrate a relationship between a reverse switchback roller and a counter roller according to the first exemplary embodiment, viewed from a thick arrow direction (the direction from the front to the back of the image forming apparatus) illustrated in FIG. 7. FIGS. 2 and 3 are diagrams each illustrating a conveyance relationship among the reverse switchback roller, the counter roller, and a sheet, viewed from the same direction in FIG. 1. In FIG. 2, the sheet is conveyed toward the outside of the apparatus. In FIG. 3, the sheet is reversed and conveyed toward the inside of the apparatus.

With reference to FIG. 7, an operation to be performed from feeding to discharging of the sheet S is described. The sheet S picked by a sheet feeding roller 701 is conveyed by a registration roller pair 702. On one side of the sheet S, a toner image is transferred by a transfer roller 703, and the toner image is heated and fixed by a fixing roller 704. It is assumed that a direction orthogonal to the direction of the sheet S which is conveyed by the registration roller pair 702 is a width direction of the sheet S. The width direction is the same as an axis direction of a photosensitive drum 703*a*. The registration roller pair 702 conveys the sheet S at a timing of an image on the photosensitive drum (image carrier) 703*a*.

Then, the sheet S is conveyed by a reverse switchback roller 105-*a*, and passes through the fixing roller 704. After the trailing end of the sheet S passes through a point (branching point) A, the reverse switchback roller 105-*a* changes the rotation direction from L (counterclockwise direction) to R (clockwise direction).

As illustrated in FIGS. 1A and 1B, a switchback roller 105-*b* is obliquely inclined to the switchback roller 105-*a* and an axis direction of the switchback roller 105-*a*. In other words, the switchback roller 105-*b* is disposed in an inclined state to a sheet width direction. The switchback roller 105-*a* is provided such a manner that the switchback roller 105-*a* is rotatable in a forward direction (direction L) and in a reverse direction (direction R) by receiving driving force from a motor M (drive source) generating the driving force. The switchback roller 105-*b* rotates being driven by the rotation of the switchback roller 105-*a*. According to the first exemplary embodiment, the switchback roller 105-*a* and the switchback roller 105-*b* serve as a reversing roller pair. A plurality of the switchback rollers 105-*b* are provided in the sheet width direction, and as illustrated in FIG. 1A, each of the switchback rollers 105-*b* inclines in the same direction to the sheet width direction. In other words, the plurality of the switchback rollers 105-*b* is provided in parallel. This configuration is similarly applied to a skew feed roller pair 705 to be described below.

When the switchback roller 105-*a* rotates in the reverse direction, the sheet S having an image formed on one side (first side) is conveyed to a duplex conveyance path. The sheet S that has passed through the duplex conveyance path is conveyed to the image forming unit (the transfer roller 703, the photosensitive drum 703*a*, and the fixing roller 704) again, and an image is formed on the back side (the second side that is the back side of the first side). According to the first exemplary embodiment, on the duplex conveyance path, the skew feed roller pair 705 is provided as a conveyance roller pair for conveying the sheet S toward the image forming unit. One roller of the skew feed roller pair 705 is inclined in the same direction as the switchback roller 105-*b*, and obliquely conveys (oblique-feed) the sheet S so that a side end (one end portion in the width direction) of the sheet S comes in contact with a reference guide (guiding member) 710. The conveyance of the sheet S in the oblique direction to the conveyance direction by the skew feed roller pair 705 makes the sheet S to be conveyed toward the image forming unit with the side end of the sheet S contacted the reference guide 710. The reference guide 710 is provided along the conveyance direction of the sheet S. The end portion of the sheet S contacts the reference guide 710A so that a position of the sheet S in the width direction can be adjusted. The term "oblique" includes a state being oblique to the reference guide 710.

In a $X_L$ section (a distance from a nip portion of the fixing roller 704 to the branching point A) where the sheet S is conveyed only by the reversing roller pair rotating in the rotation direction L, the sheet S is conveyed while moving in parallel to a C direction that is upper right of the inclination of the switchback roller 105-*b* facing the switchback roller 105-*a* illustrated in FIGS. 1A, 1B, and 2. When the sheet is nipped in both of the nip portion of the reversing roller pair and the nip portion of the fixing roller 704 and conveyed, a conveyance force of the fixing roller 704 is larger than a conveyance force of the reversing roller pair. Consequently, the sheet S is not obliquely conveyed, and the reversing roller pair slips on the sheet S.

In a $X_R$ section (a distance from a nip portion of the switchback roller 105-*a* to a nip portion of the skew feed roller pair 705) after a reversing operation of the switchback roller 105-*a* from the direction L to the direction R, as illustrated in FIGS. 1A, 1B, and 3, the rotation direction of the switchback roller 105-*a* is reversed. The sheet S is thus conveyed while moving in parallel to a C' direction that is lower left of the inclination of the switchback roller 105-*b*. That is, the sheet S is conveyed, by the reversing roller pair rotating in the reverse direction, obliquely to the conveyance direction. This enables the sheet S to be conveyed in such a manner that the side end of the sheet S, in the width direction, moves closer to a reference guide 301 and the reference guide 710.

As illustrated in FIG. 7, the duplex conveyance path branches from the conveyance path at the branching point A on the conveyance path between the fixing roller 704 and the reversing roller pair as a start point.

In the first exemplary embodiment, the distance of the section $X_L$ in which the sheet S is conveyed only by the reversing roller pair is shorter than the distance of section $X_R$. That is, since the distance of the section $X_R$ after the reversing operation of the switchback rollers 105-*a* is longer, as a result, as illustrated in FIG. 3, the sheet is conveyed while moving to the left side. To the direction the sheet S is moved, the reference guide (guiding member) 301 for determining a position of the sheet S in the direction orthogonal to the sheet conveyance direction (the width direction of the sheet S) is provided. Thus, a position in the width direction of the sheet S is adjusted while the sheet S is obliquely conveyed by the switchback roller 105-*a* and moves closer to the reference guide 301 with the side of the sheet S moved (contacting) along the reference guide 301.

When the leading edge of the sheet S being conveyed by the switchback roller 105-*a* arrives at the skew feed roller pair 705, the sheet S is further conveyed by the skew feed roller pair 705 and moves toward the reference guide 710 that determines the position of the sheet S in the width direction. In a state where the position of sheet S is adjusted by the reference guide 710, the sheet S is conveyed to the registration roller pair 702 by a re-feed roller 706, and an image is formed on the back side by the transfer roller 703 and the fixing roller 704. Then, a flapper 707 rotates in an arrow F direction, and the sheet S is discharged by a discharge roller pair 708 onto a discharge tray 709 provided outside the apparatus.

As described above, according to the first exemplary embodiment, the switchback roller 105-*b* and one of the skew feed roller pair 705 is provided in a state being inclined in the same direction to the width direction of the sheet S, an amount of movement of the sheet S (an amount of which the sheet S is obliquely conveyed) can be increased. As a result, the sheet S reliably comes in contact with the reference guides 301 and 710, and the positional accuracy of the sheet S in the width direction therefore can be ensured.

According to the above-described first exemplary embodiment, in the reversing roller pair, only the switchback roller 105-*b* is inclined. However, the present invention is not limited to the configuration. If at least one of the rollers in the reversing roller pair is inclined, the sheet S can be obliquely conveyed. Consequently, both of the reversing roller pair may be inclined to the width direction. This configuration can be similarly applied to the skew feed roller pair 705.

In the above-described first exemplary embodiment, the roller pair for discharging the sheet S and the roller pair for reversing the sheet S are provided independently. However, the present invention is not limited to the configuration. The present invention may be applied to a triple roller (a configuration in which two driven rollers face one drive roller) discussed in Japanese Patent Application Laid-Open No. 2000-26002.

Figure 10A:
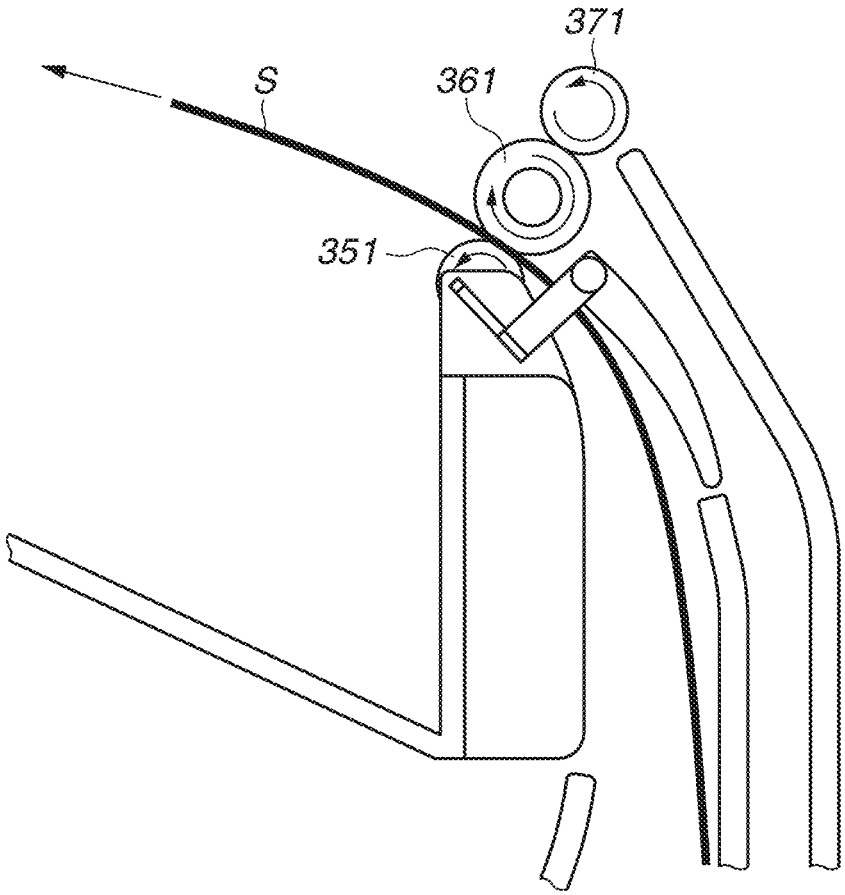
FIGS. 10A, 10B, and 10C are diagrams each illustrating an example configuration of an exemplary embodiment which is applied to a triple roller structure.
Figure 10B:
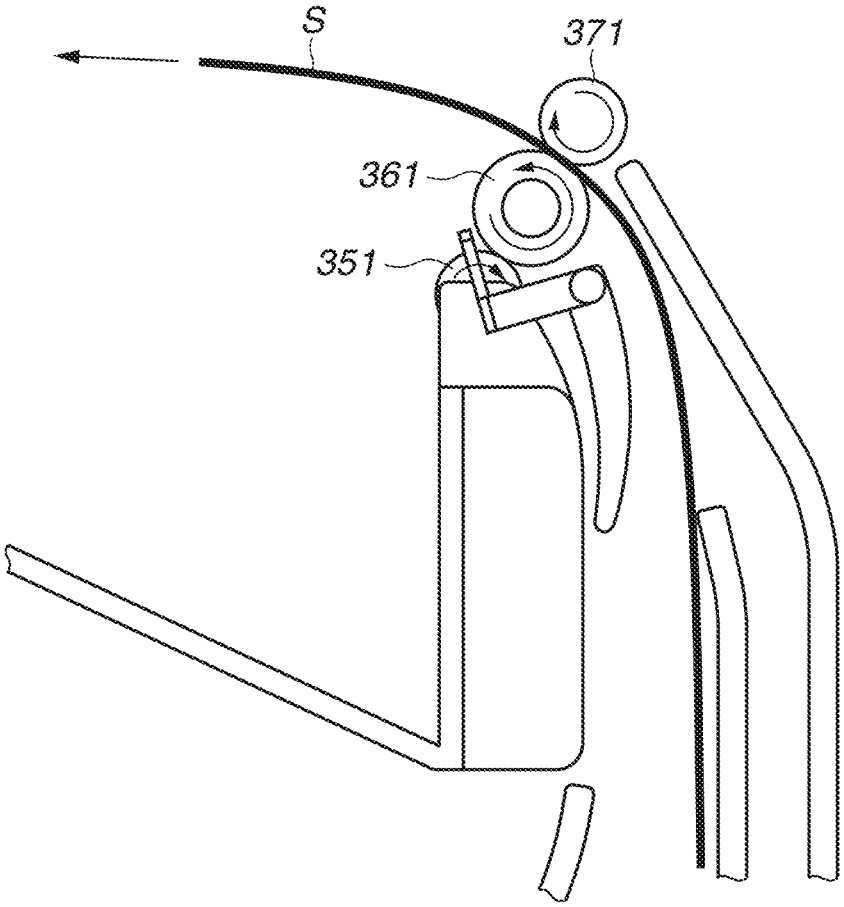
Figure 10C:
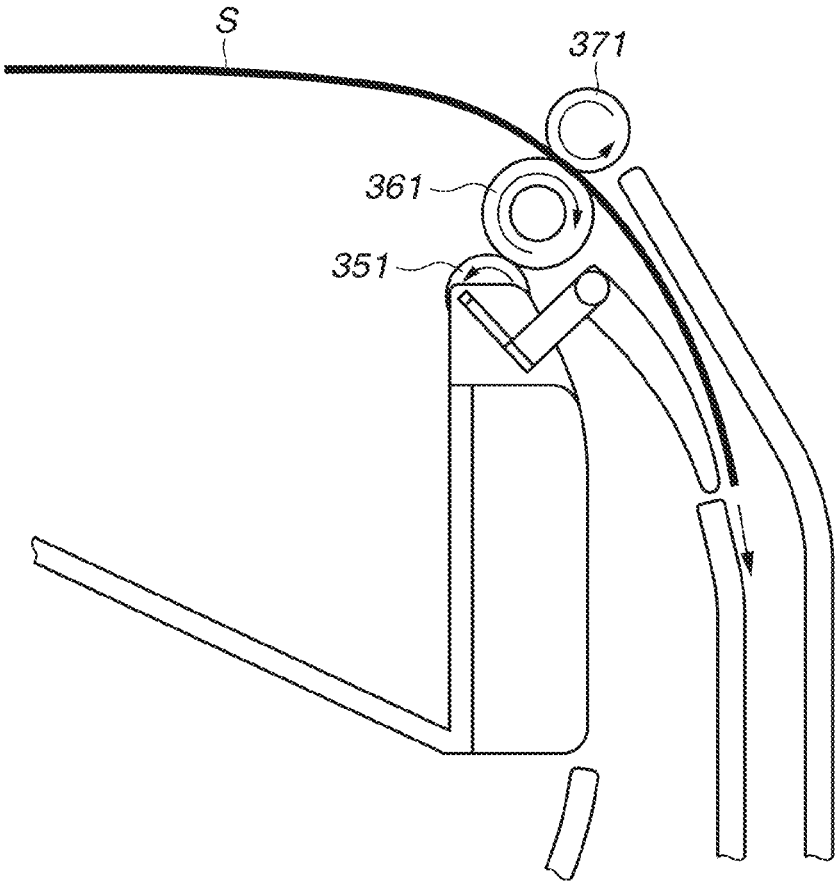

With reference to FIGS. 10A, 10B, and 10C, a configuration example of a triple roller to which the present invention is applied is described. FIGS. 10A, 10B, and 10C are diagrams each illustrating only around a triple roller having a first roller 361, a second roller 351, and a third roller 371. The other components are similar to those in the above-described first exemplary embodiment, and their descriptions are omitted.

The first roller 361 is provided in such a manner that the first roller 361 rotates in the forward direction and in the reverse direction by receiving driving force from a motor (drive source) generating the driving force.

A rotation center of the second roller 351 is provided at a position lower than a rotation center of the first roller 361, and pressed against the first roller 361. The second roller 351 and the first roller 361 form a nip portion, and the second roller 351 rotates being driven by the rotation of the first roller 361. As illustrated in FIG. 10A, when discharging the sheet S onto a stacking portion, the second roller 351 rotates being driven by the first roller 361 rotating in the forward direction.

A rotation center of the third roller 371 is provided at a position upper than the rotation center of the first roller 361, and pressed against the first roller 361. The third roller 371 and the first roller 361 form a nip portion, and the third roller 371 rotates being driven by the rotation of the first roller 361. As illustrated in FIGS. 10B and 10C, when conveying the sheet S to the image forming unit again, the third roller 371 rotates being driven by the first roller 361 which rotates in the forward direction after rotating in the reverse direction.

In the configuration in which the present invention is applied to the triple roller, the third roller 371 is provided so as to incline to an axis direction (the same direction as the sheet width direction) of the first roller 361. However, it is not necessary to provide the second roller 351 so as to incline to the first roller 361. Consequently, in the configuration in which the present invention is applied to the triple roller, when the sheet S is discharged, the sheet S can be discharged by the first roller 361 and the second roller 351. Since the first roller 361 and the second roller 351 are not inclined, the sheet S can be discharged straight. On the other hand, when the sheet S is conveyed to the image-forming unit again, since the third roller 371 is obliquely provided, the sheet S can be obliquely conveyed by the first roller 361 and the third roller 371. The sheet S obliquely conveyed by the first roller 361 and the third roller 371 is further obliquely conveyed by the skew feed roller pair 705 which is provided so as to incline in the same direction as the third roller 371, and the sheet S comes in contact with the reference guides 301 and 710.

The present invention is not limited to the configuration in which the second roller 351 and the third roller 371 rotate being driven by the first roller 361. The second roller 351 and the third roller 371 may rotate by receiving driving force from the above-described motor or other drive sources. This can be similarly applied to the other configurations in this specification.

According to the above-described first exemplary embodiment, no roller pairs is provided to the conveyance path between the fixing roller 704 and the reversing roller pair (the conveyance unit for conveying the sheet S to the reversing roller pair is the fixing roller 704). However, the present invention is not limited to the configuration.

A second exemplary embodiment of the present invention is described below. Descriptions of configurations and operations similar to those in the first exemplary embodiment are omitted in the following description of the second exemplary embodiment. Drawings relating to a configuration according to the second exemplary embodiment will be described.

Figure 4:
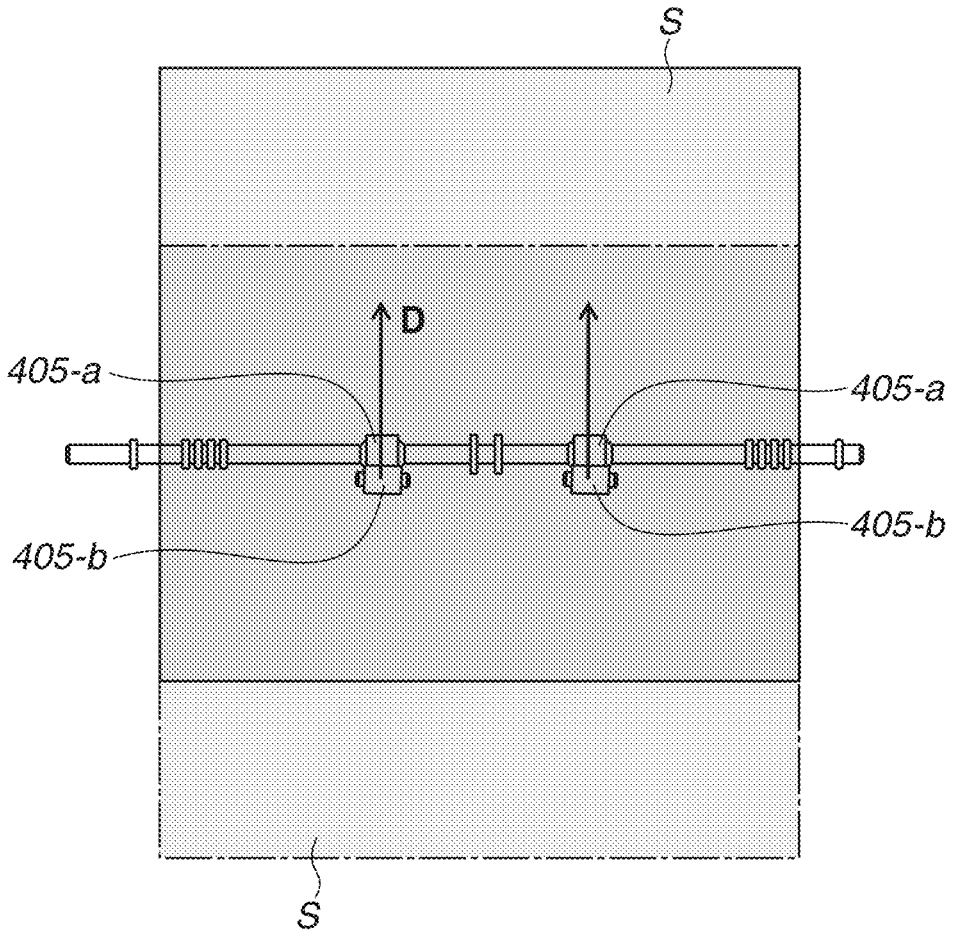
FIG. 4 is a diagram illustrating a forward direction rotation of the reverse switchback roller pair and a sheet conveyance direction according to a second exemplary embodiment.
Figure 5:
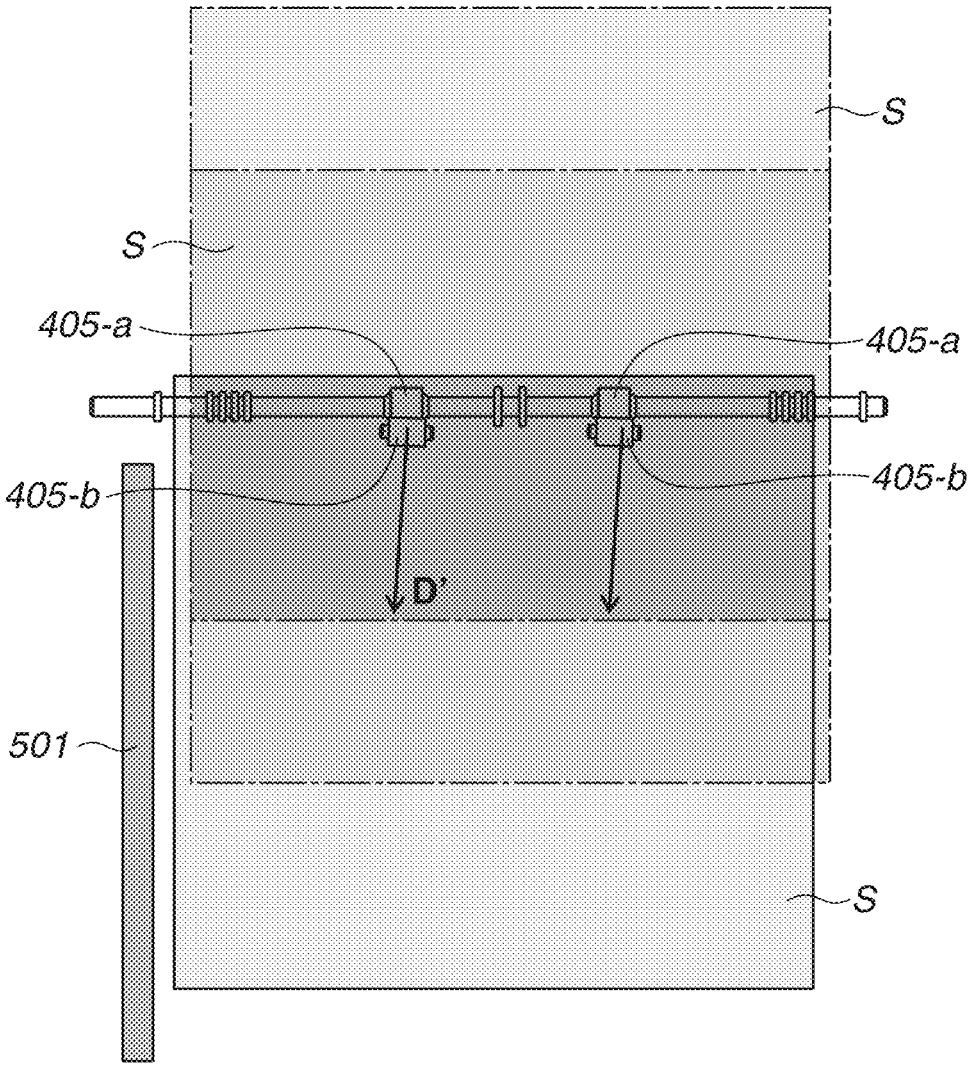
FIG. 5 is a diagram illustrating a reverse direction rotation of the reverse switchback roller pair and a sheet conveyance direction according to the second exemplary embodiment.
Figure 6A:
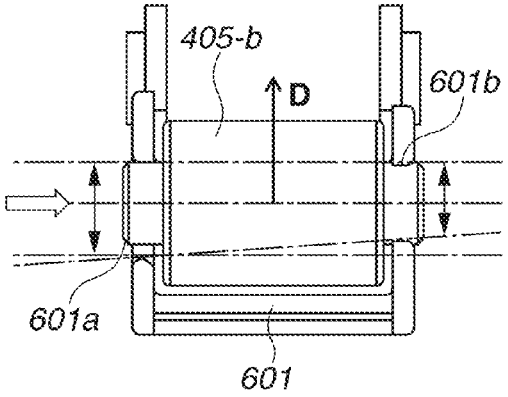
FIGS. 6A, 6B, 6C, and 6D are diagrams each illustrating inclination of a counter roller of the reverse switchback roller pair and a sheet conveyance direction according to the second exemplary embodiment.
Figure 6B:
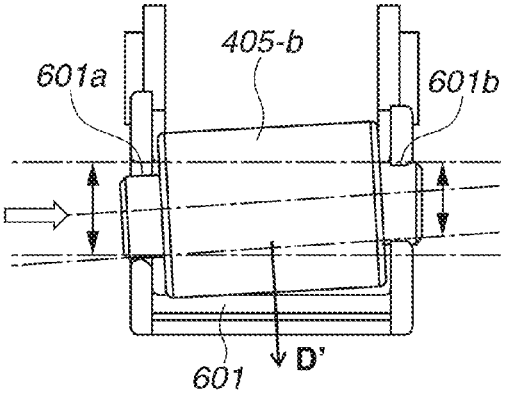
Figure 6C:
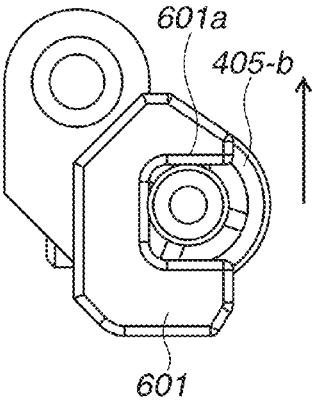
Figure 6D:
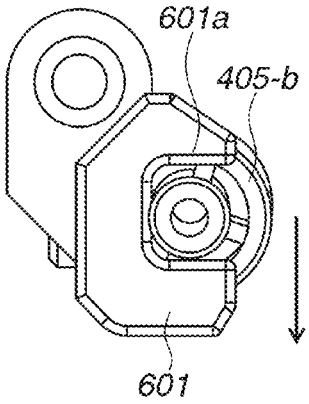
Figure 8:
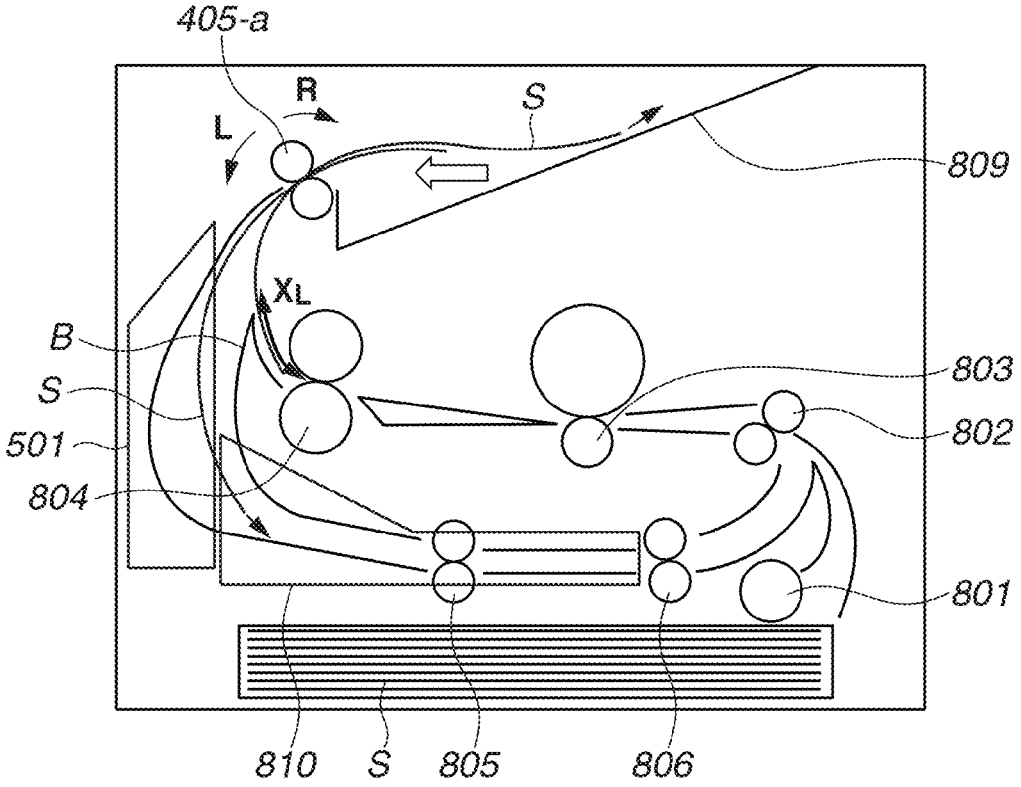
FIG. 8 is a schematic overall view illustrating an image forming apparatus according to the second exemplary embodiment.
Figure 9:
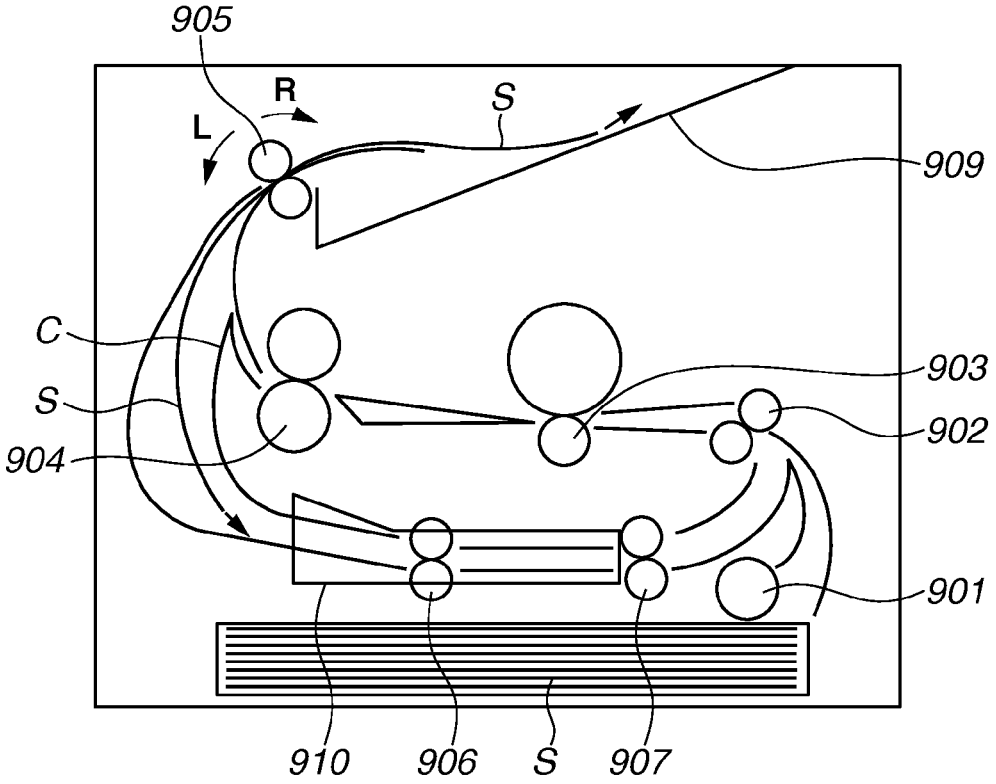
Prior Art FIG.9
FIG. 9 is a cross-sectional view illustrating a conventional image forming apparatus.

FIG. 8 is a cross-sectional view illustrating a schematic configuration of an image forming apparatus according to the second exemplary embodiment of the present invention. The right side in FIG. 8 is a front side of the image forming apparatus, and the left side in FIG. 8 is a back side of the image forming apparatus. FIGS. 4 and 5 are diagrams each illustrating a conveyance relationship among the discharge reverse switchback roller, the counter roller, and the sheet S viewed from a thick arrow direction (the direction from the front to back of the image forming apparatus) illustrated in FIG. 8. FIG. 4 is a diagram illustrating the sheet S being conveyed in a direction to the outside of the apparatus. FIG. 5 is a diagram illustrating the reversed sheet S being conveyed in a direction to the inside of the apparatus. FIGS. 6A and 6B are diagrams each illustrating a relationship between a counter roller 405-*b* and a roller holder (holding member) 601 viewed from the direction (direction from the back side of the body to the front side of the body) opposite to the thick arrow direction illustrated in FIG. 8. FIGS. 6C and 6D are diagrams each illustrating a relationship between the counter roller 405-*b* and the roller holder 601 viewed from a thick arrow direction illustrated in FIGS. 6A and 6B.

With reference to FIG. 8, an operation from feeding to discharging of the sheet S will be described. The sheet S picked by a sheet feeding roller 801 is conveyed by a registration roller pair 802. An image is then formed on the sheet S by a transfer roller 803 and a fixing roller 804.

Then, the sheet S is conveyed by a discharge reverse switchback roller 405-*a*, after passing through the fixing roller 804. When the trailing end of the sheet S has passed through a point B (branching point), the discharge reverse switchback roller 405-*a* changes the rotation direction from L to R.

According to the second exemplary embodiment, the discharge operation and the reverse operation of the sheet S are performed by the reversing roller pair that is a single roller pair. The reversing roller pair includes the discharge reverse switchback roller 405-*a* and the counter roller 405-*b*. According to the second exemplary embodiment, as illustrated in FIGS. 6A to 6D, the roller holder 601 for holding the counter roller 405-*b* holds shafts provided to both sides of the counter roller 405-*b* with a first opening 601*a* and a second opening 601*b*. A width of the first opening 601*a* that is one side (left side) of the roller holder 601 for holding the counter roller 405-*b* is wider than a width of the second opening 601*b* that is the other side (right side) of the roller holder 601. Consequently, a position where the counter roller 405-*b* comes in contact with the roller holder 601 changes depending on the rotation direction. That is, the counter roller 405-*b* does not incline when the counter roller 405-*b* rotates in the forward direction and inclines when the counter roller 405-*b* rotates in the reverse direction.

In the section $X_L$ where the sheet S is conveyed only by the reversing roller pair rotating in the rotation direction L, the sheet S is conveyed straight (in a D direction), that is, the sheet S is not obliquely conveyed. This is because, as illustrated in FIGS. 4 and 6A, the counter roller 405-*b* facing the discharge reverse switchback roller 405-*a* does not incline in the rotation.

After the reversing operation of the discharge reverse switchback roller 405-*a*, the rotation direction is reversed, and the counter roller 405-*b* inclines as illustrated in FIGS. 6B and 6D by the roller holder 601. As a result, the sheet S is obliquely conveyed in a lower right D' direction of the inclination of the counter roller 405-*b* (the lower left direction when viewed from the body front side). To the sheet moved direction, a reference guide 501 for determining an orthogonal direction to the conveyance direction is provided. The sheet S is conveyed along a contact surface of the reference guide 501, and a position of the sheet S in the width direction is determined.

When the leading end of the sheet S being conveyed by the discharge reverse switchback roller 405-*a* arrives at a skew feed roller pair 805, the sheet S is further conveyed by the skew feed roller pair 805 to move toward a reference guide 810 that determines a position of the sheet S in the width direction. The printing accuracy on the back side of the sheet S is therefore ensured. Then, the sheet S is conveyed to a registration roller pair 802 by a re-feed roller 806, and an image is formed on the back side of the sheet S by a transfer roller 803 and a fixing roller 804. The sheet is then discharged onto a discharge tray 809 by the discharge reverse switchback roller 405-*a*.

As described above, according to the second exemplary embodiment, when the reversing roller pair rotates in the forward direction to discharge the sheet S, the counter roller 405-*b* does not incline and thereby the sheet is discharged straight. When the reversing roller pair rotates in the reverse direction to convey the sheet S toward the duplex conveyance path, the counter roller 405-*b* inclines. That is, according to the second exemplary embodiment, when the reversing roller pair is rotating in the forward direction, the sheet S is prevented from moving in the opposite direction of the direction in which the sheet is expected to move. Consequently, according to the second exemplary embodiment, an amount of movement (an amount in which the sheet S is obliquely conveyed) by the reversing roller pair can be further increased.

The configuration example where the width of the first opening 601*a* of the roller holder 601 is wider than the width of the second opening 601*b* is described above. Alternatively, for example, the width of the first opening and the width of the second opening supporting both sides of the shaft of the counter roller 405-*b* may be the same, and a diameter of the shaft at one side (left side) of the counter roller 405-*b* may be narrower than a diameter of the shaft at the other side (right side) of the counter roller 405-*b*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-211993 filed Oct. 9, 2013, which is hereby incorporated by reference herein in its entirety.

What is claimed is:

1. An image forming apparatus comprising:

an image forming unit configured to form an image on a sheet;

a duplex conveyance path through which the sheet having the image formed by the image forming unit on a first side passes when an image is formed on a second side that is a back side of the first side;

a guiding member provided along the duplex conveyance path, the guiding member having a contact portion with which a side end that is one end portion of the conveyed sheet in a width direction comes in contact;

a reversing roller pair capable of rotating in a forward direction and in a reverse direction, the reversing roller pair rotating in the reverse direction after rotating in the forward direction to convey the sheet toward the duplex conveyance path; and a conveyance roller pair provided on the duplex conveyance path, the conveyance roller pair being configured to convey the sheet toward the image forming unit, wherein at least one roller of the reversing roller pair is inclined to the width direction so that, in the width direction, the side end of the sheet being conveyed by the reversing roller pair rotating in the reverse direction moves closer to the contact portion.

2. The image forming apparatus according to claim 1, further comprising:

a registration roller pair configured to convey the sheet to the image forming unit, wherein the width direction is orthogonal to a direction in which the registration roller pair conveys the sheet.

3. The image forming apparatus according to claim 1, wherein the image forming unit includes a photosensitive drum, and wherein and the width direction is an axis direction of the photosensitive drum.

4. The image forming apparatus according to claim 1, wherein at least one roller of the conveyance roller pair is inclined to the width direction, and the conveyance roller pair conveys the sheet while causing the sheet to contact the guiding member at the side end of the sheet.

5. The image forming apparatus according to claim 1, wherein the reversing roller pair includes a drive roller which is attached to a shaft rotating by receiving driving force from a drive source and a driven roller which is provided at a position facing the drive roller and rotates being driven by the drive roller, and the driven roller being inclined to an axis direction of the drive roller.

6. The image forming apparatus according to claim 1, wherein the reversing roller pair obliquely conveys the sheet to a conveyance direction.

7. The image forming apparatus according to claim 1, further comprising:

a reverse conveyance path from the image forming unit to the reversing roller pair, wherein the duplex conveyance path branches from the reverse conveyance path starting from a branching point on the reverse conveyance path, and a distance of the conveyance path from the branching point to a nip portion of the reversing roller pair is shorter than a distance of a conveyance path from the nip portion of the reversing roller pair to a nip portion of the conveyance roller pair.

8. An image forming apparatus comprising:

an image forming unit configured to form an image on a sheet;

a duplex conveyance path through which the sheet having the image formed by the image forming unit on a first side passes when an image is formed on a second side that is a back side of the first side;

a guiding member provided along the duplex conveyance path, the guiding member having a contact portion with which a side end that is one end portion of the conveyed sheet in a width direction comes in contact;

a first roller capable of rotating in a forward direction and in a reverse direction;

a second roller provided such a manner that that a rotation center of the second roller is positioned lower than a rotation center of the first roller in a vertical direction, the second roller rotating together with the first roller rotating in the forward direction in discharging of the sheet onto a stacking portion;

a third roller provided such a manner that that a rotation center of the third roller is positioned upper than the rotation center of the first roller in the vertical direction, the third roller rotating together with the first roller rotating in the forward direction after rotating in the reverse direction in conveying of the sheet to the image forming unit to form an image on a second side that is an opposite side of the first side of the sheet having an image formed by the image forming unit on the first side; and a conveyance roller pair provided on the duplex conveyance path, the conveyance roller pair being configured to convey the sheet having the image formed on the first side toward the image forming unit, wherein the third roller is inclined to the width direction so that, in the width direction, the side end of the sheet being conveyed by the third roller rotating together with the first roller rotating in the forward direction moves closer to the contact portion.

9. The image forming apparatus according to claim 8, wherein the first roller is driven to rotate by a drive source producing driving force, the second roller rotates being driven by the first roller, and the third roller rotates being driven by the first roller.

10. The image forming apparatus according to claim 8, wherein the third roller is inclined to an axis direction of the first roller.

11. The image forming apparatus according to claim 10, wherein the second roller is not inclined to the axis direction of the first roller.

12. The image forming apparatus according to claim 8, further comprising:

a conveyance unit configured to convey the sheet to a nip portion of the first roller and the third roller; and a conveyance path between the conveyance unit and the nip portion of the first roller and the third roller, wherein the duplex conveyance path branches from the conveyance path starting from a branching point on the conveyance path, and a distance of the conveyance path from the branching point to the nip portion of the first roller and the third roller is shorter than a distance of the conveyance path from the nip portion of the first roller and the third roller to a nip portion of the conveyance roller pair.

13. The image forming apparatus according to claim 8, further comprising:

a registration roller pair configured to convey the sheet to the image forming unit, wherein the width direction is orthogonal to a direction in which the registration roller pair conveys the sheet.

14. The image forming apparatus according to claim 8, wherein the image forming unit includes a photosensitive drum, and wherein the width direction is an axis direction of the photosensitive drum.

15. The image forming apparatus according to claim 8, wherein at least one roller of the conveyance roller pair is inclined to the width direction, and the conveyance roller pair conveys the sheet while causing the sheet to contact the guiding member at the side end of the sheet.

16. An image forming apparatus comprising:

an image forming unit configured to form an image on a sheet;

a duplex conveyance path through which the sheet having the image formed by the image forming unit on a first side passes when an image is formed on a second side that is a back side of the first side;

a guiding member provided along the duplex conveyance path, the guiding member having a contact portion with which a side end that is one end portion of the conveyed sheet in a width direction comes in contact;

a reversing roller pair capable of rotating in a forward direction and in a reverse direction, the reversing roller pair rotating in the reverse direction after rotating in the forward direction to convey the sheet toward the duplex conveyance path; and a holding member configured to hold at least one roller of the reversing roller pair, the holding member holding the roller so that the roller inclines to the width direction according to a change in a rotation direction of the roller.

17. The image forming apparatus according to claim 16, wherein at least one roller of the conveyance roller pair is inclined to the width direction, and the conveyance roller pair conveys the sheet while causing the sheet to contact the guiding member at the side end of the sheet.

* * * * *